US009985370B2

(12) United States Patent
Asanuma

(10) Patent No.: US 9,985,370 B2
(45) Date of Patent: May 29, 2018

(54) CONNECTOR WHICH IS CONFIGURED TO ELECTRICALLY CONNECT A FLAT CABLE TO A CIRCUIT BOARD

(71) Applicant: Molex, LLC, Lisle, IL (US)

(72) Inventor: Junichi Asanuma, Yamato (JP)

(73) Assignee: Molex, LLC, Lisle, IL (US)

( * ) Notice: Subject to any disclaimer, the term of this patent is extended or adjusted under 35 U.S.C. 154(b) by 0 days. days.

(21) Appl. No.: 15/401,279

(22) Filed: Jan. 9, 2017

(65) Prior Publication Data

US 2017/0271798 A1 Sep. 21, 2017

(30) Foreign Application Priority Data

Mar. 16, 2016 (JP) ..... 2016-052823

(51) Int. Cl.

| | |
|---|---|
| ***H01R 13/62*** | (2006.01) |
| ***H01R 12/77*** | (2011.01) |
| ***H01R 12/79*** | (2011.01) |
| ***H01R 13/26*** | (2006.01) |
| ***H01R 13/50*** | (2006.01) |

(52) U.S. Cl.

CPC ..... *H01R 12/774* (2013.01); *H01R 12/79* (2013.01); *H01R 13/26* (2013.01); *H01R 13/50* (2013.01)

(58) Field of Classification Search

CPC ..... H01R 23/668; H01R 23/684

USPC ..... 439/495, 331, 67

See application file for complete search history.

(56) References Cited

U.S. PATENT DOCUMENTS 6,960,093 B1 * 11/2005 Fan ..... H01R 12/7029 439/153

FOREIGN PATENT DOCUMENTS

JP 2011-204509 A 10/2011

* cited by examiner

*Primary Examiner* — Phuong Chi T Nguyen

(74) *Attorney, Agent, or Firm* — James A. O'Malley

(57) ABSTRACT

A connector includes a housing, terminals and a lock member. The housing has an insertion slot for inserting a flat cable having an engaging protruding portion projecting outward in the transverse direction. The terminals are mounted in the housing for establishing an electrical connection with conductive wires in the flat cable. The lock member is mounted on the housing for locking a flat cable inserted into the insertion slot. The lock member includes a spring member having a free end vertically displaceable with respect to the housing and an engaging protrusion connected to the free end of the spring member. The engaging protrusion has an inclined edge portion formed in the front in the insertion direction of the flat cable. The inclined edge portion is inclined relative to the insertion direction of the flat cable when viewed from above.

14 Claims, 7 Drawing Sheets

CONNECTOR WHICH IS CONFIGURED TO ELECTRICALLY CONNECT A FLAT CABLE TO A CIRCUIT BOARD

RELATED APPLICATIONS

This application claims priority to Japanese Application No. 2016-052823, filed Mar. 16, 2016, which is incorporated herein by reference in its entirety.

TECHNICAL FIELD

The present disclosure relates to a connector.

BACKGROUND ART

A cable connector is used to connect a flat cable such as a flexible printed circuit (FPC) board or a flexible flat cable (FFC) (see, for example, Patent Document 1).

FIG. 7 is a perspective view showing a connector of the prior art.

In this drawing 811 is a housing for a connector made of an insulating material. A cable insertion recessed portion 813 is formed to receive and accommodate the leading end portion of a flat cable 901. Terminals not shown in the drawing are mounted inside the cable insertion recessed portion 813, and each terminal is able to make contact with a conductive trace 951 exposed on the surface of the leading end portion of the flat cable 901. The connector is mounted on a substrate not shown in the drawing such as a circuit board. In this way, the conductive traces 951 on the flat cable 901 inserted into the cable insertion recessed portion 813 of the housing 811 can establish an electrical connection with the conductive traces on the board via the terminals.

The connector also has lock members 881 held by the housing 811. The lock members 881 are accommodated and held inside the lock accommodating recessed portion 817 connected to both ends of the cable insertion accommodating portion 813. Each lock member 881 includes a cantilevered movable arm portion 883 extending forward from the rear, an engaging protrusion 885 formed near the leading end of the movable arm portion 883 and projecting upwards, and a release operation piece 886. The engagement protrusions 885 have a substantially triangular side profile with the hypotenuse formed in front. The upper end of the release operation piece 886 passes through a slit formed in the ceiling of the lock accommodating recessed portion 817 and protrudes to the upper surface of the housing 811.

When the leading end portion of the flat cable 901 is inserted into the cable insertion recessed portion 813 in front of the housing 811, the left and right sides of the leading end portion of the flat cable 901 are inserted into the lock accommodating recessed portions 817. Because the sides overcome the hypotenuse in front of the engaging protrusions 885 as they move forward, the movable arm portions 883 are elastically deformed and the engaging protrusions 885 are pushed downward. As the leading end portion of the flat cable 901 moves further into the cable insertion recessed portion 813, the notch portions 914 formed in the sides of the leading end portion of the flat cable 901 reach the engaging protrusions 885, and the spring action of the movable arm portions 883 lift the engaging protrusions 885 to engage the notch portions 914.

Because the flat cable 901 is locked, it cannot become inadvertently detached from the housing 811. When the flat cable 901 is detached, the release operation pieces 886 are displaced downward to lower the engaging protrusion 885, disengage the notch portions 914, and unlock the flat cable 901.

Patent Document 1: JP 2011-204509 A

SUMMARY

However, in a connector of the prior art, when the leading end portion of a flat cable 901 is inserted into the cable insertion recessed portion 813 while inclined to the left or right, the first of the left and right sides of the leading end portion of the flat cable 901 is inserted into the cable insertion recessed portion 813 but comes into contact with the inside surface of the engaging protrusion 885 without overcoming the front hypotenuse of the engaging protrusion 885. As a result, the side cannot push the engaging protrusion 885 downward and becomes damaged when it strikes the engaging protrusion 885.

The present disclosure provides a reliable, low-cost connector with a simple configuration into which a flat cable can be easily inserted without becoming detached and in which a flat cable is not damaged when inserted on an incline.

A connector is provided which comprises a housing including an insertion slot for inserting a flat cable having an engaging protruding portion projecting outward in the transverse direction, terminals mounted in the housing for establishing an electrical connection with conductive wires in the flat cable, and a lock member mounted on the housing for locking a flat cable inserted into the insertion slot, the lock member including a spring member having a free end vertically displaceable with respect to the housing and an engaging protrusion connected to the free end of the spring member, the engaging protrusion having an inclined edge portion formed in the front in the insertion direction of the flat cable, and the inclined edge portion being inclined relative to the insertion direction of the flat cable when viewed from above.

In another connector, the inclined edge portion is inclined so that the distance from the center of the housing in the transverse direction gradually decreases moving forward in the insertion direction of the flat cable.

In another connector, the engaging protrusion includes a vertical edge portion formed on the inside in the insertion direction of the flat cable, the vertical edge portion engaging the engaging protruding portion to lock the flat cable.

In another connector, an engaging protrusion is positioned inside locking recessed portions on both ends of the insertion slot, the opposite side of the locking recessed portions relative to the center of the housing in the transverse direction are demarcated by side wall portions having forward protruding portions projecting from the front surface of the housing, the side wall portions being inclined surfaces formed in the front in the insertion direction of the flat cable, and being inclined so that the distance from the center of the housing in the transverse direction gradually decreases moving forward in the insertion direction of the flat cable.

In another connector, the spring member is a cantilevered leaf spring extending in the insertion direction of the flat cable.

In another connector, the spring member is a cantilevered leaf spring extending inward from the front in the insertion direction of the flat cable.

In the present disclosure, the connector does not damage a flat cable even when the flat cable is inserted on an incline. The flat cable also does not become detached. In addition, the configuration can be simplified, costs can be reduced, and reliability can be improved.

BRIEF DESCRIPTION OF THE DRAWINGS

FIGS. 3A and 3B are a pair of perspective views of the shell of the connector in the first embodiment, in which FIG. 3A is partially cut away and FIG. 3B includes a flat cable in FIG. 3A;

FIGS. 4A and 4B are a first pair of diagrams used to explain the operation for connecting a flat cable to the connector in the first embodiment, in which FIG. 4A is a front view of the connector and FIG. 4B is a first view showing the positional relationship between the connector and the flat cable from arrows A-A in FIG. 4A;

FIGS. 5A and 5B are a second pair of diagrams used to explain the operation for connecting a flat cable to the connector in the first embodiment, in which FIG. 5A is a second view showing the positional relationship between the connector and the flat cable from arrows A-A in FIG. 4A, and FIG. 5B is a third view showing the positional relationship between the connector and the flat cable from arrows A-A in FIG. 4A;

DETAILED DESCRIPTION OF THE PREFERRED EMBODIMENTS

The following is a detailed explanation of embodiments of the present invention with reference to the drawings.

Figure 1:
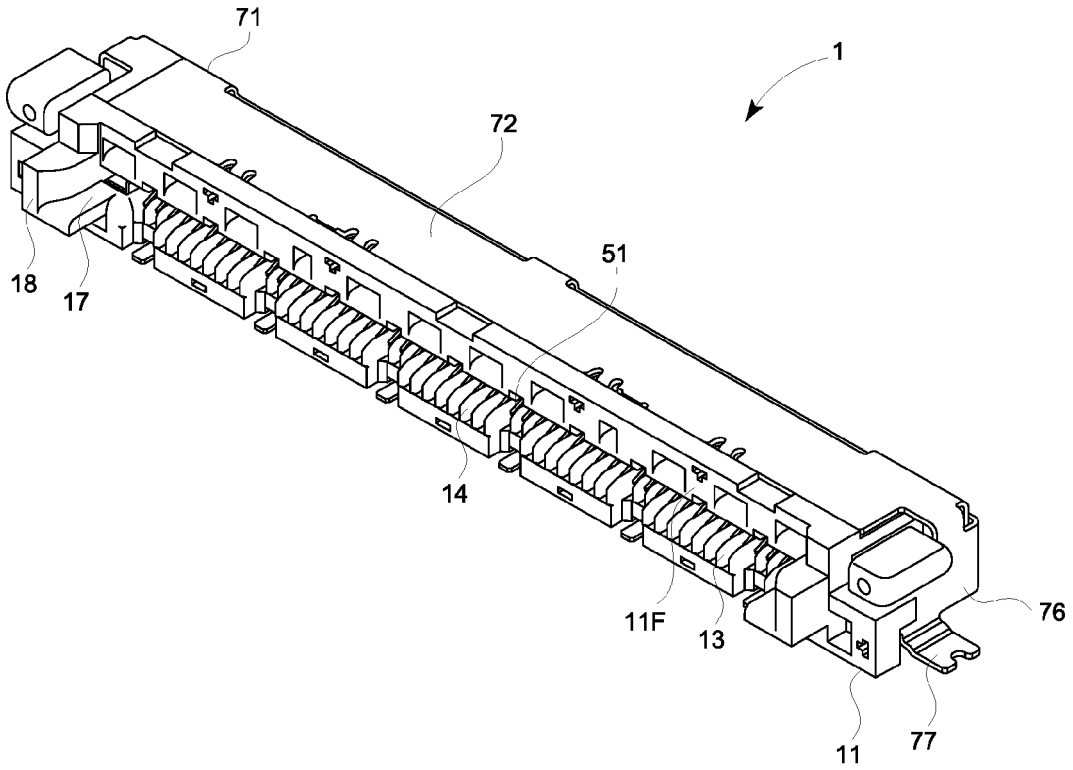
FIG. 1 is a perspective view of the connector in the first embodiment.
Figure 2:
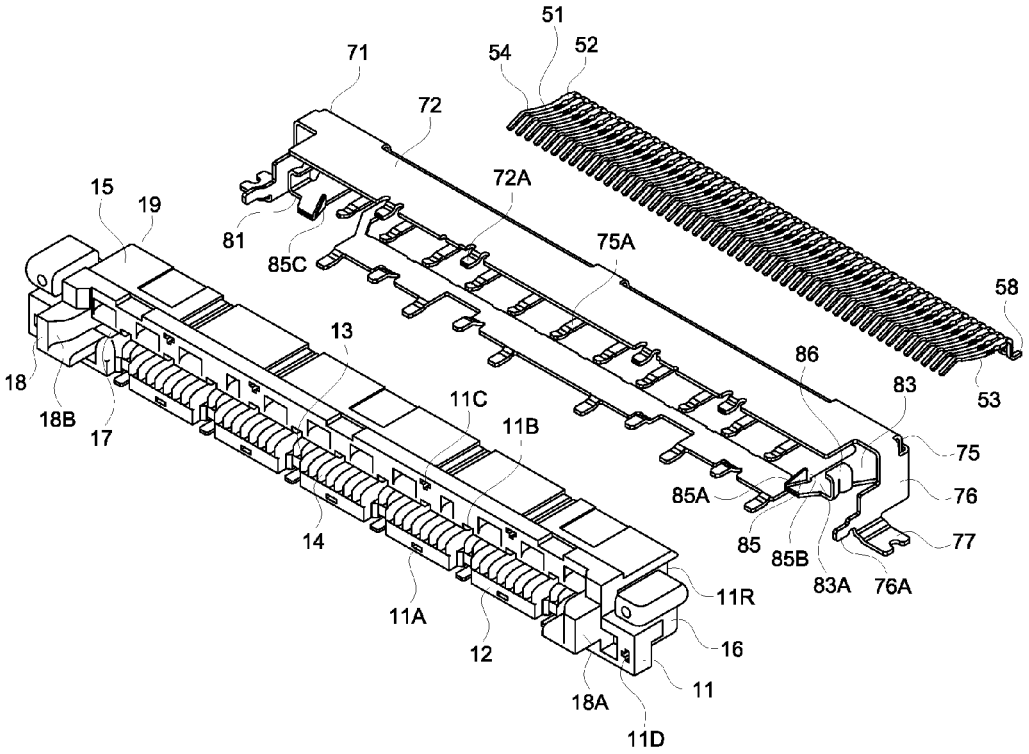
FIG. 2 is an exploded view of the connector in the first embodiment.
Figure 3A:
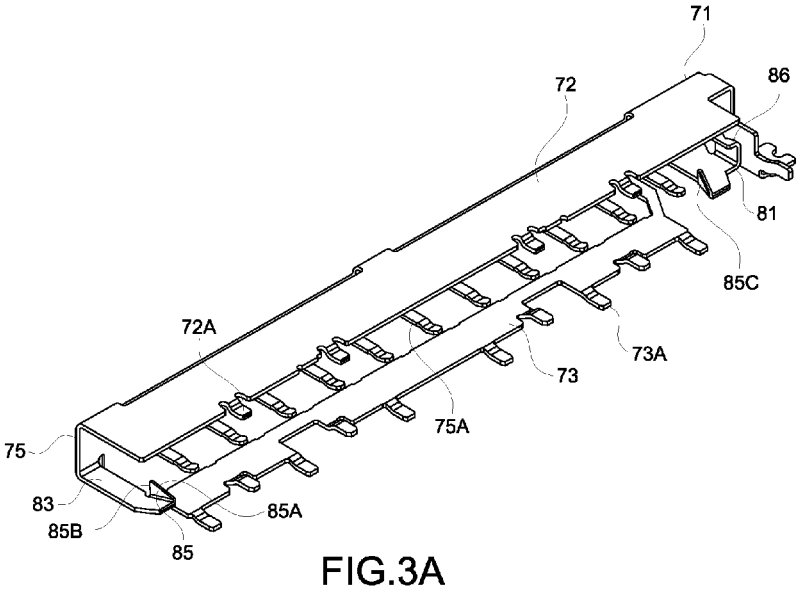
Figure 3B:
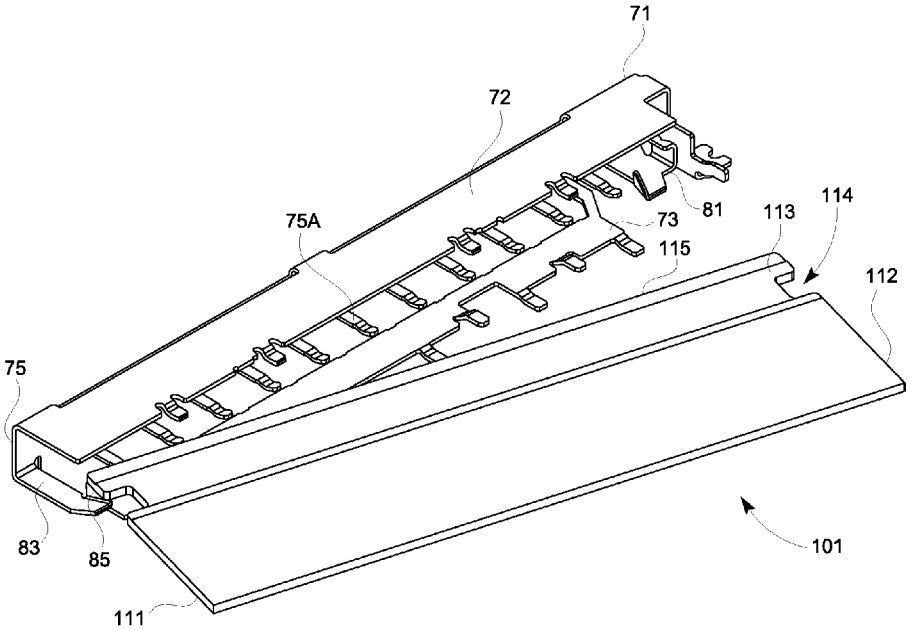

FIG. 1 is a perspective view of the connector in the first embodiment, FIG. 2 is an exploded view of the connector in the first embodiment, and FIGS. 3A and 3B are a pair of perspective views of the shell of the connector in the first embodiment. FIG. 3A is partially cut away and FIG. 3B includes a flat cable in FIG. 3A.

In these drawings, 1 is the cable connector in the present embodiment, which is mounted on a board not shown in the drawings such as a circuit board, and is used to establish an electrical connection with a flat cable 101 containing conductive wires not shown in the drawings such as a flexible circuit board or a flexible flat cable. For convenience of explanation, the connector 1 used here is a cable connector with a non-ZIF (zero insertion force) structure in which a flat cable 101 can be connected simply by inserting the flat cable 101 into the insertion slot 13. A cable connector with a ZIF structure or a cable connector requiring a movable member such as an actuator can also be used. Any type of flat cable 101 with conductive wires (conductive traces) can be used.

In the present embodiment, the expressions indicating direction, such as upper, lower, left, right, front and rear, which are used to explain the configuration and operation of each portion of the card connector 1 and flat cable 101 are relative and not absolute. They depend on the orientation of the card connector 1 and flat cable 101, and their constituent components shown in the drawings. When the orientation of the card connector 1 and flat cable 101 or their constituent components changes, the interpretation changes in response to the change in orientation.

The connector 1 has an integrally molded housing 11 made of an insulating material such as a synthetic resin, a plurality of integrally formed terminals 51 made of a conductive material such as metal to connect electrically to conductive wires in the flat cable 101, and a shell 71 serving as a cover member mounted on the housing 11.

The housing 11 has a lower portion 12, upper portion 15, left and right side portions 16, and an insertion slot 13 for inserting a flat cable 101 in the front (from the lower left in FIG. 1 and FIG. 2) which is formed between the lower portion 12, the upper portion 15, and the side portions 16. In the present embodiment, the surface on the entrance side of the insertion slot 13 (the lower left side in FIG. 1 and FIG. 2) is referred to as the front surface 11*f* of the housing 11 or the connector 1, and the inside of the insertion slot 13 (the upper right side in FIG. 1 and FIG. 2) is referred to as the rear surface 11*r* of the housing 11 or the connector 1. The portion consisting of the lower portion 12, the upper portion 15, and the side portions 16, including the insertion slot 13, is referred to as the main body portion 19.

A plurality of terminal receiving grooves 14 are formed in the lower portion 12 of the housing 11 for mounting terminals 51. The terminal receiving grooves 14 are arranged at a predetermined pitch (for example, 0.5 mm), and a single terminal 51 is mounted in each terminal receiving groove 14. The terminals 51 mounted in the terminal receiving grooves 14 are formed by stamping and bending a metal sheet. A terminal 51 does not have to be mounted in all of the terminal receiving grooves 14. Some terminals 51 can be omitted depending on the arrangement of conductive wires in the flat cable 101.

Each terminal has a main body portion 52 pinched and held inside a terminal receiving groove 14, an arm portion 53 extending forward and upwards from the front end of the main body portion 52, a contact portion 54 formed near the leading end of the arm portion 53 and curved so as to bulge upwards, and a tail portion 58 serving as a board connection portion extending downward from the rear end of the main body portion 52. The lower end of the tail portion 58 extends to the rear and the lower surface is fixed to a connecting pad formed on the surface of the board by a conductive fixing means such as solder. In this way, the terminal 51 is connected electrically to a conductive trace not shown in the drawing connected to the connecting pad. The contact portion 54 is connected electrically to a conductive wire exposed on the bottom surface of the flat cable 101.

Here, as shown in FIG. 3B, the flat cable 101 has a base portion 111, which is a thin, insulating plate member with a slender, band-like shape, and a plurality of conductive wires not shown in the drawing arranged on one surface (the lower surface in the drawing) of the base portion 111. FIG. 3B shows only the portion of the flat cable 101 near the leading edge 115 inserted into the insertion slot 13 in the front surface 11*f* of the connector 1. The rest of the flat cable has been omitted. The conductive wires are linear strips of foil made of a conductive metal such as copper arranged in parallel at a predetermined pitch (for example, 0.5 mm) and covered by a film-like insulating layer having electrically insulative properties. However, the insulating layer is removed a predetermined length from the leading edge 115 of the flat cable 101 to expose the surface of the conductive wires. This is inserted into the insertion slot 13 with the exposed surface of the conductive wire facing downwards.

A recessed portion 114 recessed inward from the left and right side edges 112 of the flat cable 101 in the transverse direction and an ear portion 113 serving as an engaging protruding portion projecting outward relative to the recessed portion 114 in the transverse direction is formed on both sides near the leading end of the flat cable 101. In the example shown in the drawing, the ear portions 113 do not protrude outward in the transverse direction relative to the side edges 112. The position of the side edges of the ear portions 113 is the same as that of the side edges 112. The ear portions 113 are formed a predetermined distance from the leading edge 115 of the flat cable 101, and the recessed portion 114 is positioned near the rear of the ear portions 113.

The shell 71 has an upper panel portion 72 covering at least a portion of the upper surface of the upper portion 15 of the housing 11, a lower panel portion 73 covering at least a portion of the lower surface of the lower portion 12 of the housing 11, a rear panel portion 75 covering at least a portion of the rear surface 11*r* of the housing 11, and side panel portions 76 covering at least portions of the outer surfaces of the side portions 16 of the housing 11. One or more upper mounting pieces 72*a*, lower mounting pieces 73*a*, and side mounting pieces 76*a* extending forward are integrally formed on the front edges of the upper panel portion 72, lower panel portion 73, and side panel portions 76. Also, one or more middle mounting pieces 75*a* extending forward are integrally formed in the rear panel portion 75. The upper mounting pieces 72*a*, middle mounting pieces 75*a*, lower mounting pieces 73*a*, and side mounting pieces 76*a* are inserted into upper mounting recessed portions 11*c*, middle mounting recessed portions 11*b*, lower mounting recessed portions 11*a*, and side mounting recessed portions 11*d* formed in the housing 11 so as to open into the front surface 11*f*. In this way, the shell 71 is mounted and fixed to the housing 11. A tail portion 77 extends outward from the lower end of each side panel portion 76 as a board connecting portion. The lower surfaces of the tail portions 77 serving as board connecting portions are fixed by a fixing means such as solder to fixing pads formed on the surface of the board.

The shell 71 includes a cable holding portion 81 serving as a lock member arranged near the side panel portion 76 on both the left and right side panel portions 76. Each cable holding portion 81 has a main body portion 83 extending forward from the rear panel portion 75 (forward in the insertion direction of the flat cable 101), a mounting portion 86 connected to a side edge of the main body portion 83, and an engaging protrusion 85 connected to a side edge of the leading end of the main body portion 83.

When the shell 71 is mounted on the housing 11, the cable holding portions 81 are housed inside lock recessed portions 17 formed on both ends of the insertion slot 13 in the transverse direction opening so as to extend with a slender profile in the transverse direction of the front surface 11*f* of the housing 11. A forward protruding portion 18 extending forward from the front surface 11*f* is formed on both ends of the insertion slot 13 in the transverse direction of the housing 11, and the outside of the lock recessed portions 17 in the transverse direction (on the opposite side of the center of the housing 11 in the transverse direction) is defined by the side wall portion 18*a* of the forward protruding portions 18. An inclined surface 18*b* tapered so that the distance from the center of the housing 11 in the transverse direction gradually decreases moving forward is created near the front end of the inside surface of both side wall portions 18*a*.

The mounting portions 86 of the cable holding portions 81 are mounted and attached to the side wall portions 18*a*. The portion of main body portion 83 of each cable holding portion 81 at least in front of the mounting portion 86 is a cantilevered portion 83*a* serving as a spring member or leaf spring elastically deformable in the vertical direction of the housing 11 (in the direction orthogonal to the transverse direction of the housing 11 and the insertion direction of the flat cable 101). Therefore, the engaging protrusion 85 on the free end of the cantilevered portion 83*a* is elastically deformable in the vertical direction of the housing 11.

In the example shown in the drawings, the engaging protrusion 85 is a plate-like protruding piece extending upwards vertically from the plate-like main body portion 83 extending in the longitudinal direction and transverse direction, and has a side profile resembling a right triangle. The front end portion of the engaging protrusion 85 corresponding to the hypotenuse of the side profile forms an inclined edge portion 85*a* serving as a guiding inclined portion inclined so as to be higher moving to the rear (inside in the insertion direction of the flat cable 101). The rear end portion of the engaging protrusion 85 connected to the rear end of the inclined edge portion 85*a* forms a vertical edge portion 85*b* arranged substantially perpendicular to the main body portion 83. Therefore, when the flat cable 101 is inserted into the insertion slot 13, as shown in FIG. 3B, the ear portion 113 moves along the inclined edge portion 85*a* and smoothly overcomes the engaging protrusion 85. When the engaging protrusion 85 enters the recessed portion 114, the vertical edge portion 85*b* engages the front end of the recessed portion 114, that is, the rear end of the ear portion 113. This effectively prevents disengagement.

Also, the engaging protrusion 85 is inclined relative to the longitudinal direction (the insertion direction of the flat cable 101) in plan view, that is, when viewed from above. More specifically, in plan view, the inclined edge portion 85*a* does not extend in the longitudinal direction but rather on an incline so that the distance from the center of the housing 11 in the transverse direction gradually decreases moving forwards (towards the front in the insertion direction of the flat cable 101). Therefore, the inside surface 85*c* of the engaging protrusion 85 is inclined so that the distance from the center of the housing 11 in the transverse direction gradually decreases moving forwards.

In this way, when a flat cable 101 is inserted into the insertion slot 13 on an incline, as shown in FIG. 3B, that is, with the front surface 11*f* of the housing 11 and the leading edge 115 of the flat cable 101 not parallel but rather inclined relative to each other, one of the ear portions 113 (the one on the left in the example shown in the drawing) comes into contact with the engaging protrusion 85 from the center in the transverse direction of the housing 11, but the ear portion 113 cannot overcome the inclined edge portion 85*a*. Thus, the ear portion 113 can advance along the inclined edge portion 85*a*. In FIG. 3B, some of the cable holding portion 81 on the left side has been cut away in order to more easily explain the positional relationship between the ear portion 11 and the engaging protrusion 85.

The following is an explanation of the operation performed to connect a flat cable 101 to a connector 1 with this configuration. In the following explanation, the flat cable 101 is connected to the connector 1 after the flat cable 101 has been inserted into the insertion slot 13 in the connector 1 at an incline so that the front surface 11*f* of the housing 11 and the leading edge 115 of the flat cable 101 are not parallel but rather inclined relative to each other when viewed from above.

Figure 4A:
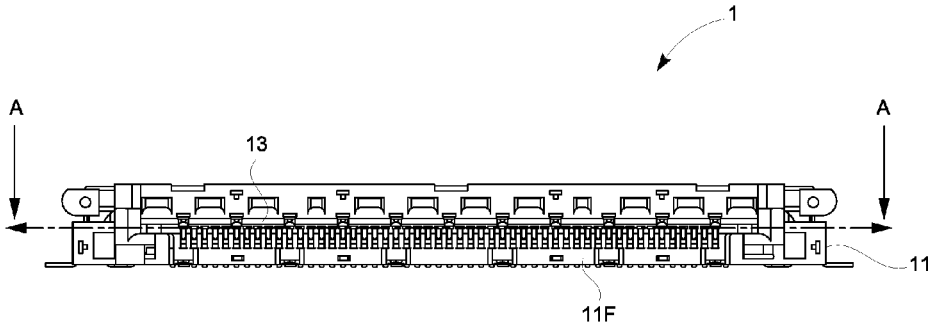
Figure 4B:
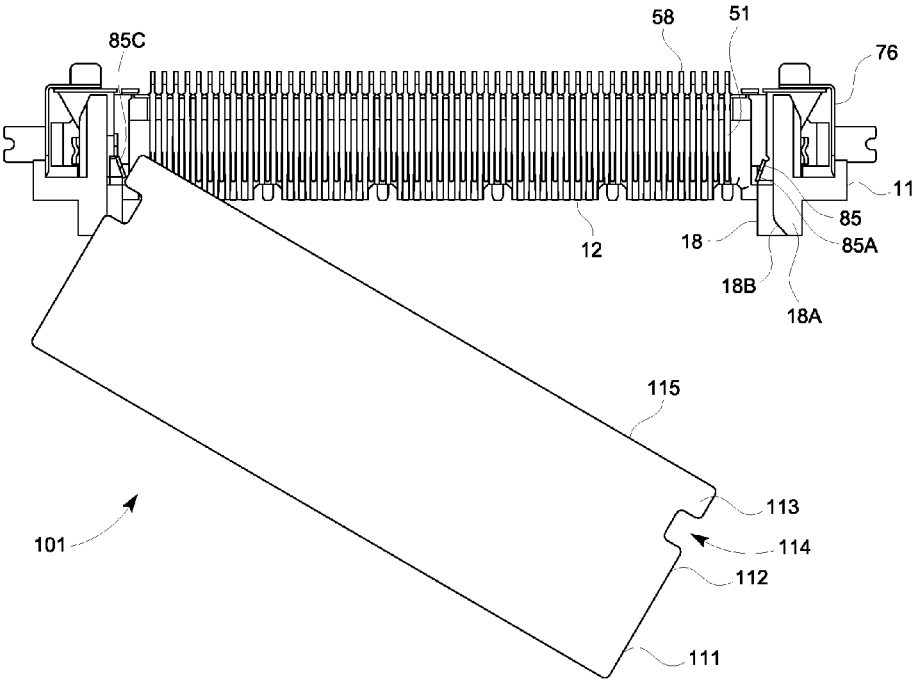
Figure 5A:
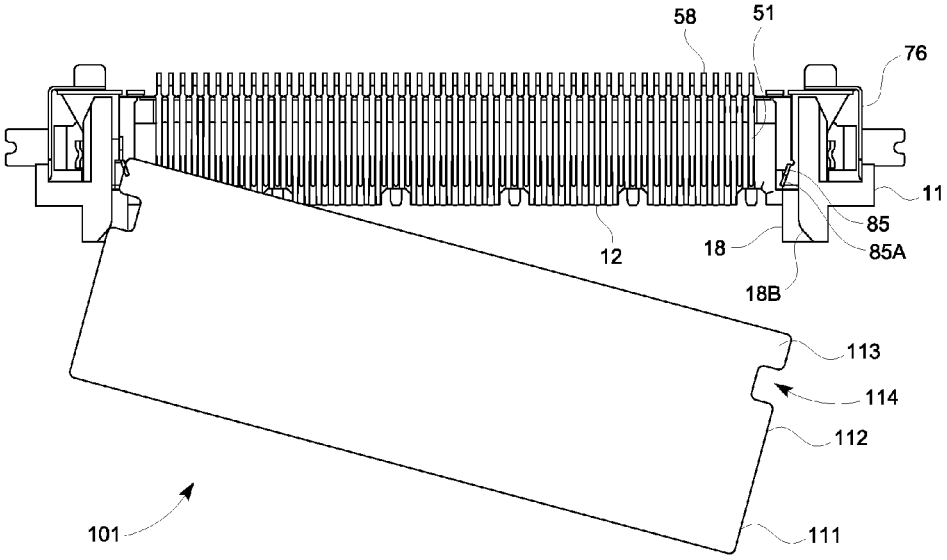
Figure 5B:
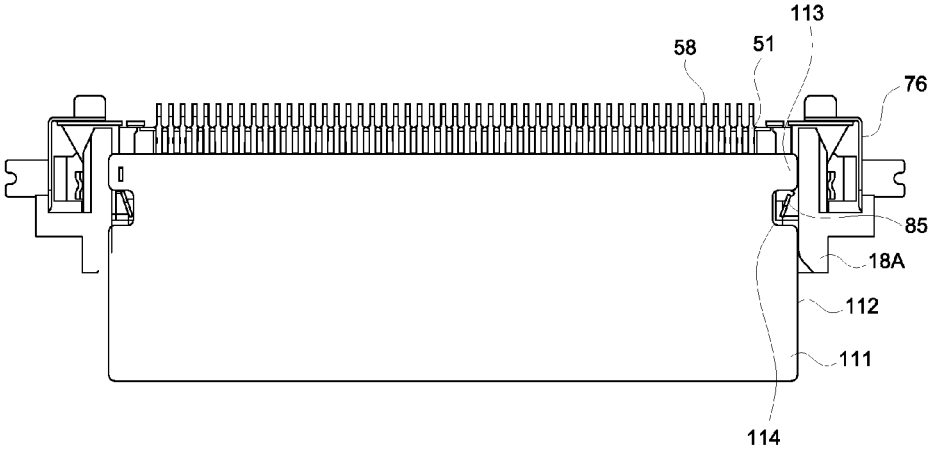

FIGS. 4A and 4B are a first pair of diagrams used to explain the operation for connecting a flat cable to the connector in the first embodiment, and FIGS. 5A and 5B are a second pair of diagrams used to explain the operation for connecting a flat cable to the connector in the first embodiment. FIG. 4A is a front view of the connector and FIG. 4B is a first view showing the positional relationship between the connector and the flat cable from arrows A-A in FIG. 4A. FIG. 5A is a second view showing the positional relationship between the connector and the flat cable from arrows A-A in FIG. 4A and FIG. 5B is a third view showing the positional relationship between the connector and the flat cable from arrows A-A in FIG. 4A.

First, the operator manually positions the flat cable 101 relative to the connector 1 so that the leading edge 115 of the flat cable 101 is facing the insertion slot 13 in the connector 1. At this time, when viewed from above, the front surface 11*f* of the housing 11 is preferably parallel to the leading edge 115 of the flat cable 101. However, the front surface 11*f* of the housing 11 may be difficult to view because the connector 1 is mounted somewhat inside the electrical device or electronic device. When the orientation of the flat cable 101 is difficult to control, the flat cable 101 may become inclined, that is, when viewed from above, the front surface 11*f* of the housing 11 and the leading edge 115 of the flat cable 101 are inclined relative to each other.

In this situation, when the operator advances the flat cable 101 relative to the connector 1, as shown in FIG. 4B, one of the ear portions 113 (the one on the left in the example shown in the drawing) is ahead of the other one, and enters the lock recessed portion 17 connected to one end (the left end in the example shown in the drawing) in the transverse direction of the insertion slot 13. At this time, the forward protruding portion 18 projecting forward from the front surface 11*f* is present on the outside of the lock recessed portion 17 in the transverse direction. Therefore, one side edge 112 near the leading edge 115 of the flat cable 101 comes into contact with the inside surface of the side wall portion 18*a* of the forward protruding portion 18 and stops. Because the front end of the inside surface of the side wall portion 18*a* is an inclined surface 18*b*, the side edge 112 is not damaged by the contact.

When the operator advances the flat cable 101 further, the flat cable 101 rotates in plan view around the portion of the side edge 112 making contact with the inclined surface 18*b* of the side wall portion 18*a* and, as shown in FIG. 5A, the other ear portion 113 (the one on the right in the example shown in the drawing) moves along the lock recessed portion 17 connected on the other end of the insertion slot 13 in the transverse direction (on the right end in the example shown in the drawing). At this time, the rotation of the flat cable 101 causes the one ear portion 113 to come into contact with the engaging protrusion 85 from the center in the transverse direction of the housing 11 (from the right side in the example of the present invention). In other words, in the drawing, the portion of the side edge 112 on the left coming into contact with the inclined surface 18*b* of the side wall portion 18*a* rotates counterclockwise around the center, and moves from right to left to make contact with the engaging protrusion 85 on the left.

Here, when viewed from above, the engaging protrusion 85 is inclined in the longitudinal direction, and the inclined edge portion 85*a* is inclined so that the distance from the center in the transverse direction of the housing 11 gradually decreases moving forward. In the drawing the engaging protrusion 85 on the left is inclined so that the leading end of the inclined edge portion 85*a* is inclined downward and to the right. The inclined edge portion 85*a* is inclined so that it becomes lower moving forward (downward in the drawing).

Therefore, one of the ear portions 113 can overcome the inclined edge portion 85*a* of the engaging protrusion 85 and advance along the inclined edge portion 85*a*. In other words, in the drawing, the ear portion 113 on the left overcomes the inclined edge portion 85*a* of the engaging portion 85 on the left, and can smoothly advance to the left along the inclined edge portion 85*a*. Because the cantilevered portion 83*a* is elastically deformable, the engaging protrusion 85 is pushed down by the ear portion 113 and is elastically displaced downward. In this way, the ear portion 113 is not damaged by contact with the inside surface 85*c* of the inclined edge portion 85*a*.

Then, when the flat cable 101 is rotated, the other ear portion 113 (the one on the right in the example shown in the drawing) enters the lock recessed portion 17 connected to the other end of the insertion slot 13 in the transverse direction (the right end in the example shown in the drawing) and overcomes the inclined edge portion 85*a* of the engaging protrusion 85.

When the operator advances the flat cable 101 further once both ear portions 113 have entered the lock recessed portions 17 connected to both ends of the insertion slot 13 in the transverse direction and overcome the inclined edge portions 85*a* of the protruding portions 85, both ear portions 113 push down the engaging protrusions 85 and advance along the inclined edge portions 85*a*. Next, when the recessed portions 114 adjacent to the rear of the ear portions 113 are directly above the engaging protrusions 85, the engaging protrusions 85 are rapidly moved upward by the spring action of the cantilevered portions 83*a*, and enter and engage the recessed portions 114 as shown in FIG. 5B. The impact of the engaging protrusions 85 suddenly being returned upward by the spring action of the cantilevered portions 83*a* is detected by the operator as a click. Because the vertical edge portions 85*b* engage the front ends of the recessed portions 114, that is, the rear ends of the ear portions 113, disengagement is effectively prevented.

In this way, connection of the flat cable 101 to the connector 1 is completed, the flat cable 101 is held and locked by the pair of cable holding portions 81, and the flat cable 101 is kept from becoming detached from the connector 1. The operator can detect when the flat cable 101 has been connected to the connector 1 by detecting a click.

When the flat cable 101 is not inclined relative to the connector 1 and the leading edge 115 is parallel to the front surface 11*f* of the housing 11, the leading edge 115 of the flat cable 101 can be inserted into the insertion slot 13 in the connector 1. In this case, both ear portions 113 advance into the lock recessed portions 17 connected to both ends of the insertion slot 13 in the transverse direction, and can overcome the inclined edge portions 85*a* of the engaging protrusions 85. Then, both engaging protrusions 85 enter the recessed portions 114, the rear ends of the ear portions 113 are engaged, the flat cable 101 is held and locked by the pair of cable holding portions 81, and the flat cable 101 is kept from becoming detached from the connector 1.

In the present embodiment, the connector 1 comprises a housing 11 including an insertion slot 13 for receiving flat cable 101 having ear portions 113 protruding outwards in the transverse direction, terminals 51 mounted in the housing 11 for establishing an electrical connection with the conductive wires in the flat cable 101, and cable holding portions 81 mounted in the housing 11, the cable housing portions 81 locking the flat cable 101 inserted into the insertion slot 13. Each cable holding portion 81 includes a cantilevered portion 83*a* with a free end displaceable in the vertical direction of the housing 11, and an engaging protrusion 85 connected to the free end of the cantilevered portion 83*a*, the engaging protrusion 85 including an inclined edge portion 85*a* formed in front in the insertion direction of the flat cable 101, and the inclined edge portion 85*a* being inclined in the insertion direction of the flat cable 101 when viewed from above. More specifically, the inclined edge portion 85*a* is inclined so that the distance from the center of the housing 11 in the transverse direction gradually decreases moving forward in the insertion direction of the flat cable 101.

In this way, a flat cable 101 can be easily inserted without damaging portions of the flat cable 101 such as the ear portions 113, even when the flat cable 101 has been inserted into the insertion slot 13 on an incline. Because both engaging protrusions 85 reliably engage the both ear portions 113 of the flat cable 101, the flat cable 101 is reliably locked, and the flat cable 101 cannot be detached from the connector 1. Because the structure of the connector 1 is simple, costs associated with the connector 1 can be reduced, and the reliability of the connector 1 can be improved.

The protruding portions 85 also include a vertical edge portion 85*b* formed on the inside in the insertion direction of the flat cable 101, and the vertical edge portions 85*b* engage the ear portions 113 to lock the flat cable 101. Because the ear portions 113 of the flat cable 101 are reliably locked in this manner, the flat cable 101 is effectively prevented from becoming detached from the connector 1.

The engaging protrusions 85 are positioned inside the lock recessed portions 17 on both ends of the insertion slot 13, and the opposite side of the lock recessed portions 17 relative to the center of the housing 11 in the transverse direction is defined by the side wall portion 18*a* of the forward protruding portions 18. An inclined surface 18*b* tapered so that the distance from the center of the housing 11 in the transverse direction gradually decreases moving forward is created near the front end of the inside surface of both side wall portions 18*a*, and the side wall portions 18*a* include an inclined surface 18*b* formed in front in the insertion direction of the flat cable 101, the inclined surfaces 18*b* being inclined so that the distance from the center in the transverse direction of the housing 11 gradually decreases moving forward in the insertion direction of the flat cable 101. In this way, the flat cable 101 rotates around the portion of the side edge 112 making contact with the inclined surface 18*b* and is shifted from an inclined orientation to the correct orientation, that is, the orientation can be corrected so that the leading edge 115 is parallel to the front surface 11*f* of the housing 11. Here, the side edges 112 are not damaged even if they come into contact with the inclined surfaces 18*b*.

The cantilevered portion 83*a* is a cantilevered leaf spring extending in the insertion direction of the flat cable 101. Therefore, the engaging protrusion 85 connected to the free end of the cantilevered portion 83*a* can be smoothly displaced in the vertical direction and the flat cable 101 can be reliably locked without damaging the flat cable 101.

The following is an explanation of the second embodiment. The structural elements identical to those in the first embodiment are denoted by the same reference numbers and further explanation of these structural elements has been omitted. Further explanation of operations and effects identical to those in the first embodiment has also been omitted.

Figure 6:
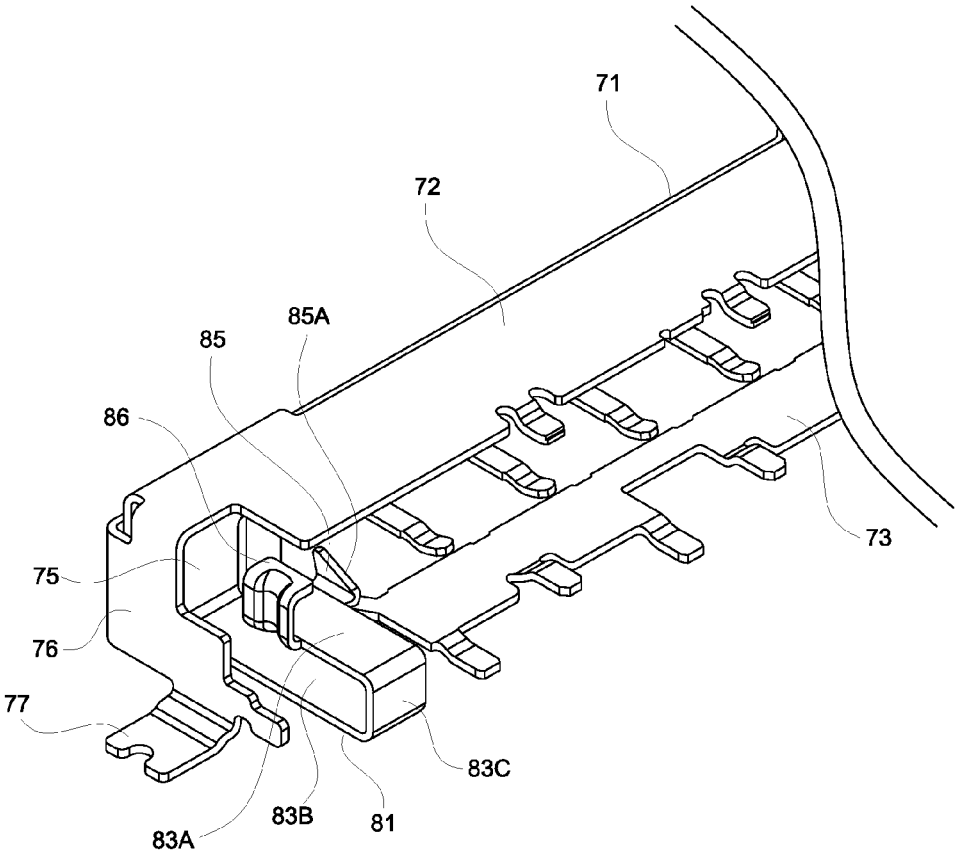
FIG. 6 is a perspective view of the shell of the connector in the second embodiment.
Figure 7:
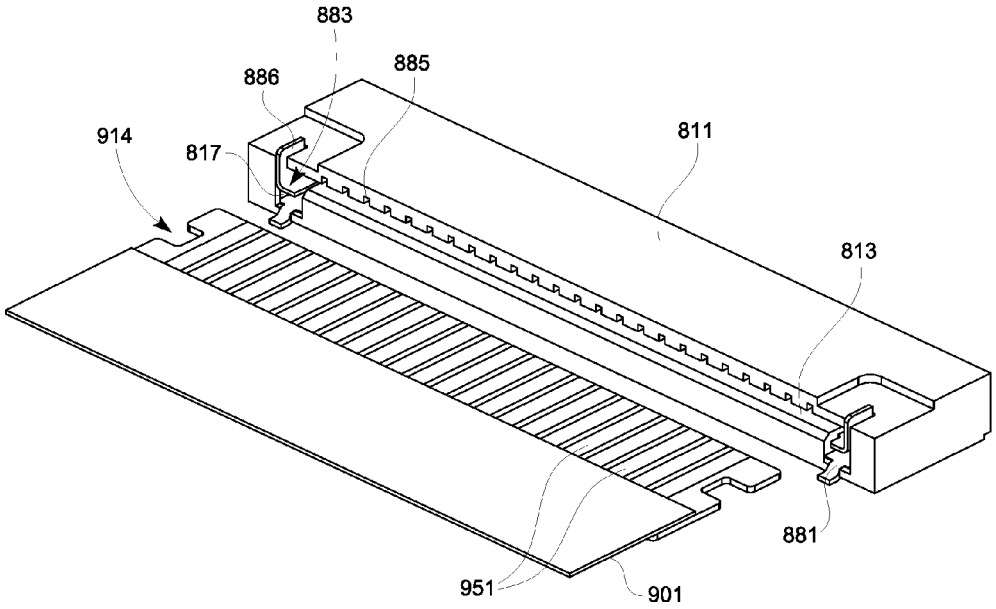
FIG. 7 is a perspective view showing a connector of the prior art.

FIG. 6 is a perspective view of the shell of the connector in the second embodiment.

The shell 71 in the connector 1 of the present embodiment has cable holding portions 81 of the shape shown in the drawing. When the shell 71 is mounted on the housing 11, the cable holding portions 81 are housed inside the lock recessed portion 17. For convenience of explanation, only half of the shell 71 is shown in the drawing. The other half of the shell 71 has been omitted.

The main body portion 83 of each cable holding portion 81 has a lower portion 83*b* extending forward from the rear panel portion 75, a U-turn portion 83*c* connected to the leading end of the lower portion 83*b* and extending to the rear after being bent upwards at a 180-degree angle, and a cantilevered portion 83*a*, which is elastically deformable in the vertical direction, connected to the leading end of the U-turn portion 83*c* and extending to the rear. The mounting portion 86 mounted and fixed on the side wall portion 18*a* is connected to the side edge of the leading end of the U-turn portion 83*c*.

Also, the engaging protrusion 85 is connected to the leading side edge of the cantilevered portion 83*a*. The engaging protrusion 85 has the same configuration as the engaging protrusion 85 in the first embodiment, and the upper end portion on the front side of the engaging protrusion 85 is an inclined edge portion 85*a* inclined so as to become higher towards the rear, and the rear end portion of the engaging protrusion 85 connected to the rear end of the inclined edge portion 85*a* is a vertical edge portion 85*b* substantially perpendicular relative to the cantilevered portion 83*a*. The engaging protrusion 85 is also inclined relative to the longitudinal direction in plan view. More specifically, the inclined edge portion 85*a* does not extend in the longitudinal direction but rather at an incline so that the distance from the center of the housing 11 in the transverse direction gradually decreases moving forward.

The rest of the configuration of the shell 71 is identical to the one in the first embodiment so further explanation has been omitted.

Thus, in the present embodiment, the cantilevered portion 83*a* of the cable holding portion 81 is a leaf spring whose free end extends in the trailing direction relative to the insertion direction of the flat cable 101, and the engaging protrusion 85 is positioned on the free end, which is the trailing end of the cantilevered portion 83*a*. Therefore, when the ear portion 113 enters the lock recessed portion 17 and overcomes the inclined edge portion 85*a* of the engaging protrusion 85, the cantilevered portion 83*a* is smoothly deformed, and the engaging protrusion 85 is smoothly displaced downwards. As a result, the ear portion 113 does not sustain strong resistance from the engaging protrusion 85 and is not damaged.

Because the configuration and operation of the connector 1 and the flat cable 101 are the same as those in the first embodiment, further explanation has been omitted.

In the present embodiment, the cantilevered portion 83*a* is a cantilevered leaf spring extending inward from the front in the insertion direction of the flat cable 101. Therefore, the engaging protrusion 85 connected to the free end of the cantilevered portion 83*a* can be smoothly displaced in the vertical direction, and the flat cable 101 is less likely to be damaged.

In the disclosure of the present specification, characteristics related to specific preferred embodiments were described. A person of ordinary skill in the art could naturally devise other embodiments, modifications, and variations with reference to the disclosure of the present specification without departing from the spirit and scope of the appended claims.

The present disclosure can be applied to a connector.

The invention claimed is:

1. A connector which is configured to electrically connect a flat cable to a circuit board, the flat cable having conductive wires, the connector comprising:

a housing having front and rear surfaces, upper and lower portions, left and right side portions, and an insertion slot which is formed between the upper and lower portions and the left and right side portions, the insertion slot being configured to receive the flat cable therein from the front surface of the housing, the insertion slot having a lock recessed portion provided at a transverse end thereof;

terminals mounted in the housing for establishing an electrical connection with the conductive wires of the flat cable; and a lock member mounted on the housing for locking the flat cable within the insertion slot, the lock member includes a cantilevered portion and an engaging protrusion, the cantilevered portion being positioned within the lock recessed portion of the insertion slot, the cantilevered portion having a free end that is elastically deformable in a vertical direction, the engaging protrusion being connected to the free end, the engaging protrusion having an inclined edge portion, the inclined edge portion being inclined from a front end thereof to a rear end thereof.

2. The connector according to claim 1, wherein the cantilevered portion is a spring member.

3. The connector according to claim 1, wherein the cantilevered portion is a leaf spring.

4. The connector according to claim 1, wherein the lower portion has a plurality of grooves formed therein which are configured to receive the terminals.

5. The connector according to claim 1, wherein the engaging protrusion has a vertical edge portion provided rearward of the inclined edge portion, the vertical edge portion being configured to engage an engaging protruding portion of the flat cable in order to lock the flat cable within the insertion slot.

6. The connector according to claim 1, wherein the lock member is formed as a part of a shell, wherein the shell covers at least a portion of at least one of an upper surface of the upper portion, a lower surface of the lower portion, the rear surface, and outer surfaces of the side portions.

7. The connector according to claim 6, wherein the shell has a tail portion which is configured to be mounted to the circuit board.

8. The connector according to claim 1, wherein a protruding portion extends forward from the front surface of the housing, the protruding portion defining an inner side wall portion, the inner side wall portion of the protruding portion defining an outer boundary of the lock recessed portion.

9. The connector according to claim 8, wherein the protruding portion has an inclined surface that is tapered inwardly from a front thereof to a rear thereof.

10. The connector according to claim 8, wherein the lock member has a mounting portion, the mounting portion being mounted to the inner side wall portion.

11. The connector according to claim 1, wherein the insertion slot has first and second lock recessed portions provided at transverse ends thereof, and wherein first and second lock members are mounted on the housing for locking the flat cable within the insertion slot, each lock member including a cantilevered portion and an engaging protrusion, the cantilevered portion of the first lock member being positioned within the first lock recessed portion of the insertion slot, the cantilevered portion of the second lock member being positioned within the second lock recessed portion of the insertion slot.

12. The connector according to claim 11, wherein first and second protruding portions extend forward from the front surface of the housing, each protruding portion defining an inner side wall portion, the inner side wall portion of the first protruding portion defining an outer boundary of the first lock recessed portion, the inner side wall portion of the second protruding portion defining an outer boundary of the second lock recessed portion.

13. The connector according to claim 12, wherein each of the first and second protruding portions have an inclined surface that is tapered inwardly from a front thereof to a rear thereof.

14. The connector according to claim 12, wherein each of the first and second lock members has a mounting portion, the mounting portion of the first lock member being mounted to the inner side wall portion of the first protruding portion, the mounting portion of the second lock member being mounted to the inner side wall portion of the second protruding portion.

* * * * *